US005832568A

United States Patent [19]

Higuchi

[11] Patent Number: 5,832,568

[45] Date of Patent: Nov. 10, 1998

[54] BAG TOP BINDING DEVICE AND MANUFACTURING METHOD THEREOF

[76] Inventor: Yasuo Higuchi, Tu 602-51, Kamakura-shi, kanagawa-ken , 248, Japan

[21] Appl. No.: 841,255

[22] Filed: Apr. 29, 1997

[30] Foreign Application Priority Data

Apr. 30, 1996 [JP] Japan ..... 8-142093

[51] Int. Cl.[6] ..... A44B 21/00; A45F 5/00

[52] U.S. Cl. ..... 24/30.5 R; 24/30.5 P; 24/30.5 S

[58] Field of Search ..... 24/30.5 R, 30.5 P, 24/30.5 S, 30.5 T, 704.1; 12/142 LC, 113

[56] References Cited

U.S. PATENT DOCUMENTS

| | | | |
|---|---|---|---|
| 416,771 | 12/1889 | Wilson | 24/30.5 P |
| 3,363,293 | 1/1968 | Nemrod et al. | 24/30.5 P |
| 4,631,783 | 12/1986 | Hayashi | 24/30.5 S |
| 5,167,086 | 12/1992 | Fast | 24/30.5 S |
| 5,575,713 | 11/1996 | Benoit et al. | 24/704.1 |
| 5,586,353 | 12/1996 | Merser | 24/30.5 P |

FOREIGN PATENT DOCUMENTS

| | | | |
|---|---|---|---|
| 1075876 | 10/1954 | France | 24/30.5 P |

*Primary Examiner*—Victor N. Sakran
*Attorney, Agent, or Firm*—Andrus, Sceales, Starke & Sawall

[57] ABSTRACT

In binding packing bags or the like, there has been difficulties with performing a speedy binding operation to enclose and bind around the binding part instantly, with a small range of objects to be bound, and with loss of material sheet which accrues from cutting.

In order to cope with such difficulties, the present invention provides, the binding device formed in a unified manner out of a filmy and flexible material sheet; wherein, the engaging portion 3 with the hole 4 formed therein, the narrow winding portion 2 which is extended from a side of said engaging portion 3 in order to wind around the binding part of the object to be bound, and the hooking portion 1 which is formed at the tip of said winding portion 2 in a nearly L-shaped form in order to be inserted into and hooked to said hole.

3 Claims, 17 Drawing Sheets

BAG TOP BINDING DEVICE AND MANUFACTURING METHOD THEREOF

BACKGROUND OF THE INVENTION

1. Field of the Invention

The present invention relates to a manual binding device for the top of a bag such as bags for bread and a method of manufacturing such binding devices.

2. Description of the Related Art

Hitherto, a similar type of binding device for binding the top of a bag, which is commonly used, has been a square chip made of plastic plate, such as a square chip 101 shown in FIG. 32. The square chip 101 is designed to enable, as it is, to keep binding the top of a bag. The chip has a binding hole 102 at the center and a guide slit 103 connected to the binding hole 102. This binding device is used by passing the top of a bag through the guide slit 103 into the binding hole 102.

Another type of binding device for binding the top of a bag is wire piece coated with vinyl chloride. In order to fasten the binding part, the wire needs to be wound aroundthe binding part, crossed and twisted several times with fingers. This type of device imposes considerable burden on the wrist in repeated handling because the wrist is also twisted during the process, and requires time for operation.

Another type of binding device for binding the top of a bag is adhesive tape or the like which is adhered around thebinding part, and then, wound around it. The most popular type among them is the square chips mentioned above. Such square chips have some space to print dates such as "Best if used by . . . " on. This is an advantage over the wire pieces or adhesive tapes which have no space to print dates on.

Conventional binding devices for the top of a bag have such forms as described above. The square chip is mainly used in machine packing. When this type is used in manual binding operations, extreme inconvenience is experienced. That is, a workperson must squeeze and make the binding partof an object to be bound thin, and then, guide the binding part into the binding hole 102 through the guide slit 103 formed in the square chip 101, and bind, all by hand throughout the process. Moreover, the binding part of an object tobe bound needs to be twisted firmly into a considerably thin volume before being guided into the guide slit 103. If the twist is not thin enough, the binding part tends to get stuck at the entrance of the guide slit causing trouble in smoothly guiding it into the binding hole 102.

The binding part of an object to be bound is supposed to remain squeezed in the binding hole 102 of the square chip 101. That is, the side of the plastic plate, in other words, the inside surface of the hole is supposed to maintain this squeezed state without bending. Accordingly, the square chip 101 requires suitable stiffness having about 1 mm in thickness. For a disposable binding device attachedto an object to be bound, this type requires too much wasteful material.

Further, the fixed dimension of the binding hole limits the coverage of objects to be bound with this device to oneswhich can be squeezed comparatively thin. Besides, since the device is in a form of a plate spreading horizontally around the binding part, when it is held in a hand by that part of the object to be bound, it grazes the palm causing pain. This has been a problem to be solved.

SUMMARY OF THE INVENTION

The present invention has been made in consideration of the aforementioned points. An object of the present invention is to provide a binding device for the top of a bag which makes the manual top binding operation remarkably easy and speedy, expands the coverage of objects to be bound, holds the binding part not bulky but compactly, and has enough space to print dates of "Best if used by . . . " and thelike. Another object of the present invention is to providea manufacturing process which reduces the quantity of materials consumed, and eliminates wasteful loss, thus making the manufacture more economical.

In accordance with the present invention in claim 1, there is provided a binding device comprising a filmy and flexible material sheet having an engaging portion with a hole formed therein, a narrow winding portion extending fromone side of said engaging portion in order to wind around the binding part of a bag to be bound, and a hooking portionprovided at the tip of said winding portion in a nearly L-shahad form in order to be inserted into and hooked to said hole.

In accordance with the present invention in claim 2, there is provided a binding device, wherein the width of said hooking portion at the bottom thereof is wider than that of said winding portion at the tip thereof.

In accordance with the present invention in claim 3, there is provided a binding device, wherein the hooking portion has a corner projected backward at the edge of its root in order to form a hooking limit point in the hole.

In accordance with the present invention in claim 4, there is provided a method of manufacturing a device for binding the top of a bag, wherein an appropriate rectangular or parallelogrammatic, filmy and flexible material sheet is taken as a minimum unit frame and two binding devices are cut in block in the shape of being engaged, adjoining, and nearly symmetrical to each other, forming the engaging portion, winding portion and hooking portion in a unified manner.

In accordance with the present invention in claim 5, there is provided a method of manufacturing a device for binding the top of a bag, wherein an appropriate number of binding devices which are continuously arranged in one line or in a plurality of lines are cut in block from an appropriate rectangular or parallelogrammatic, filmy and flexible material sheet in the shape of being engaged, adjoining and nearly symmetrical to each other, forming the engaging portion, winding portion and hooking portion in a unified manner.

DETAILED DESCRIPTION OF THE PREFERRED EMBODIMENTS

Figure 1:
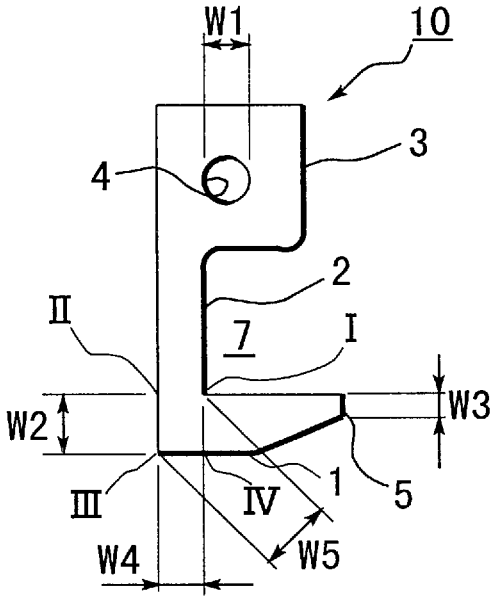
FIG. 1 is a front view to illustrate a first embodiment of the present invention.

The present invention will now be described in detail hereinafter with reference to the accompanying drawings which illustrate preferred embodiments.

EMBODIMENT 1

As shown in FIGS. 1 through 7, the device is made of a material sheet which is filmy and flexible plastic. On one side of the engaging portion 3, in which the hole 4 is formed, the winding portion 2 having an appropriate width and length is connected in a right angle against the side. At the tip of the winding portion 2, the hooking portion 1 having an appropriate width is bent in direction of a right angle or an acute angle against the winding portion in a nearly L-shaped form with each other by making the length ofthe hooking portion 1 nearly the same as the winding portion 2 or giving an appropriate difference between the two lengths. The dimension W3 at the tip of the hooking portion is made shorter than the diameter W1 of the hole 4. In such a unified forming of the engaging portion 3, the winding portion 2 and the hooking portion 1, the space 7 is formed in a U-shaped form with three sides enclosed.

"I" is the inside joint point of the hooking portion 1 and the winding portion 2 (hereinafter referred to as point I).

"II" is the outside joint point of the both portions 1, 2 (hereinafter referred to as point II).

"III" is the hooking limit point in the hole (hereinafter referred to as point III).

"IV" is the outside root point of the hooking portion (hereinafter referred to as point IV).

"V" is the underside boundary point of straight lines (hereinafter referred to as point V).

"VI" is the binding part.

For the hooking range in the hole, the dimension between the points ii and iii of the hooking portion 1 (the dimension W2, the width of the root of the hooking portion) is made larger than the hole diameter W 1 of said hole 4,and the dimension W3 at the tip of the hooking portion ismade smaller than the hole diameter W1. The dimension between the points I and II of the winding portion 2 (the dimension W4, the width of the winding portion 2) is made smaller than the hole diameter W1.

The hole 4 is formed into an appropriate shape such as complete round, circle, ellipse or polygon.

Figure 2:
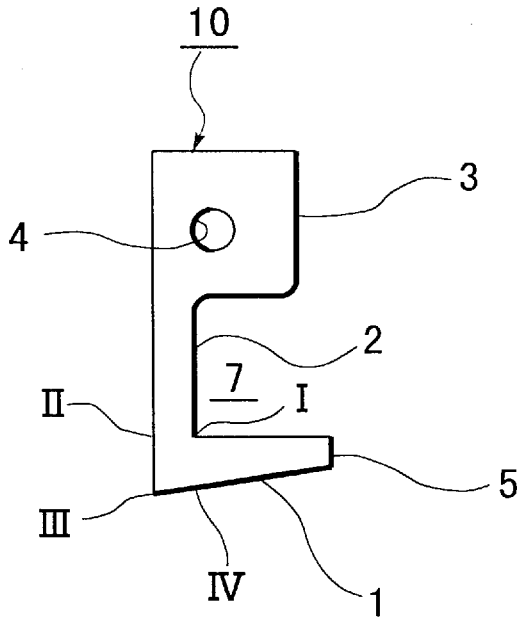
FIG. 2 is a front view to illustrate a first embodiment of the present invention.
Figure 3:
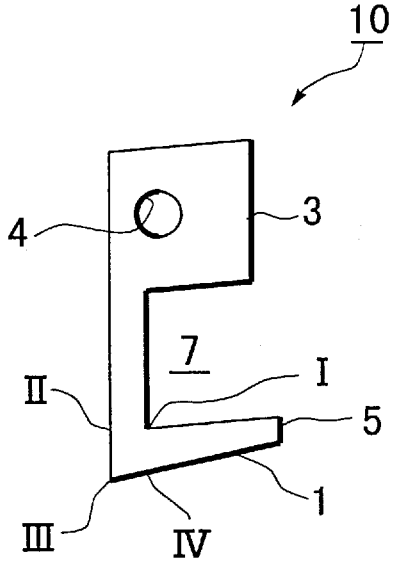
FIG. 3 is a front view to illustrate a first embodiment of the present invention.
Figure 4:
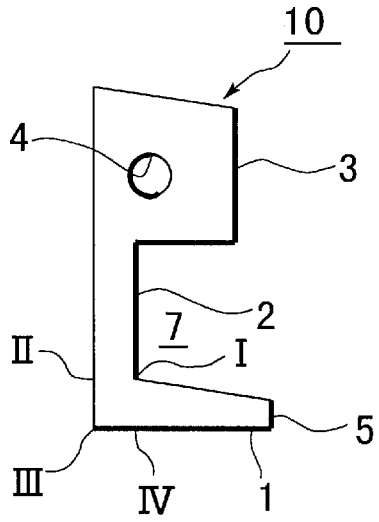
FIG. 4 is a front view to illustrate a first embodiment of the present invention.
Figure 7:
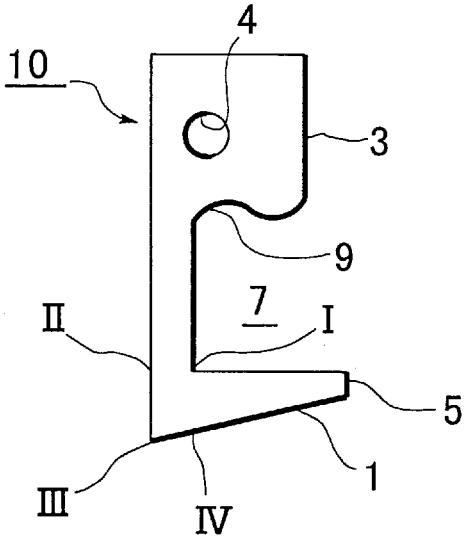
FIG. 7 is a front view to illustrate a first embodiment of the present invention.

In FIG. 1, the hooking portion 1 is formed tapered starting in its middle of the outer side IV toward the tip. In FIG. 2, tapering starts from the point III, the root of said outer side IV. In FIG. 3, the side of the engaging portion 3, which is in parallel with the hooking portion 1, is formed slanted in parallel to the slanted side of the tapered hooking portion 1. In FIG. 4, the inner side of thehooking portion 1 is formed slanted and tapered from the root toward its tip, and the side of the engaging portion 3,which is in parallel to this inner side, is also formed slanted. As shown in FIG. 7, a concave 9 may be formed in aside of the engaging portion 3 which forms the space 7.

Figure 5:
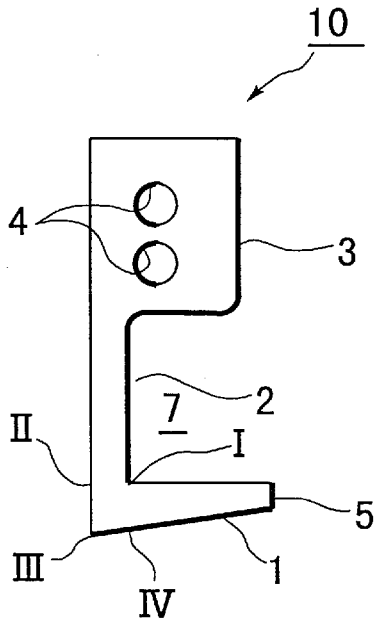
FIG. 5 is a front view to illustrate a first embodiment of the present invention.
Figure 6:
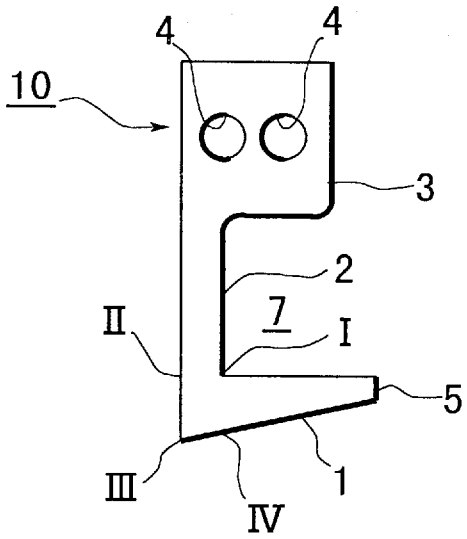
FIG. 6 is a front view to illustrate a first embodiment of the present invention.

Although all the above-mentioned structural examples shown in each figure have one hole 4, a plurality of holes may be formed, as shown in FIG. 5, a plurality of holes 4 arranged in parallel to the winding portion 2, or as shown in FIG. 6, two or more holes 4 arranged at right angles to the winding portion 2.

Figure 8:
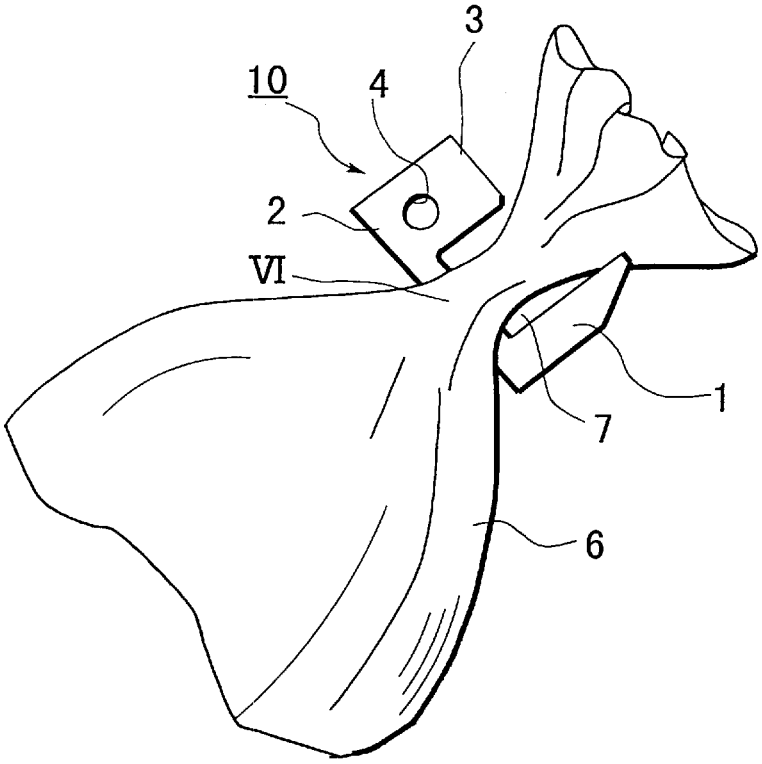
FIG. 8 is a perspective view to illustrate how to use a first embodiment of the present invention.
Figure 9:
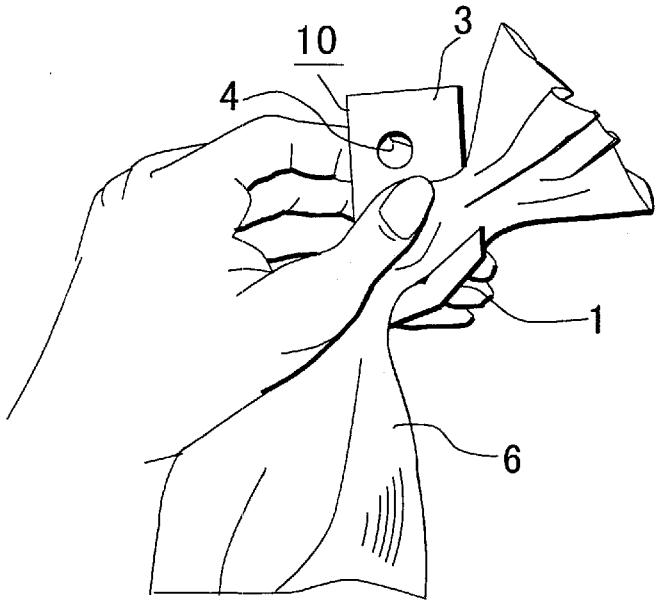
FIG. 9 is a perspective view to illustrate how to use a first embodiment of the present invention.
Figure 10:
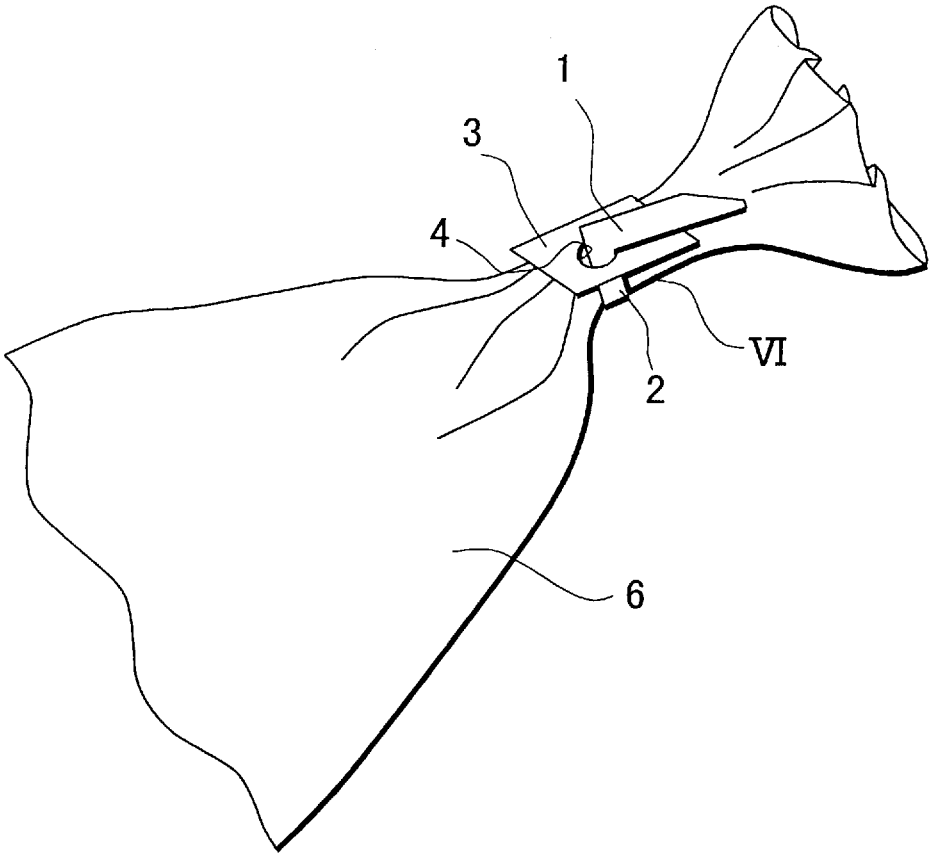
FIG. 10 is a perspective view to illustrate the completed binding according to a first embodiment of the present invention.

FIGS. 8 through 10 will illustrate how to use the binding device 10 for the top of a bag according to the above-mentioned structures. As shown in FIG. 8, any bindingdevice shown in each figure mentioned above, is held in three fingers, the thumb, the forefinger and the middle finger. The position of the thumb is this side of the binding device 10 and near the center of the winding portion 2. The forefinger and the middle finger are positioned on the opposite side near the engaging portion 3 and the winding portion 2. In the space 7 enclosed in a U-shaped form, that is, on the winding portion 2, the binding part VI of the object to be bound 6, lightly squeezed, is placed and pressed by the thumb.

Then, the hooking portion 1 is, being held by the thumb and the forefinger of the other hand, turned about 80 degrees counterclockwise against the winding portion 2, and inserted by its tip 5 into the hole 4 in the engaging portion 3. The inserted hooking portion 1 is held and pulled by the thumb and the forefinger which have been holding the binding device 10. At this time, either the thumb or the forefinger, both of which inserted the hooking portion 1 into the hole 4, is moved to the opposite side of the engaging portion 3 to hold the upper part of the engaging portion 3 between both the fingers. The corner of the hooking portion 3, an L-shaped form against the winding portion 2, on being pulled, easily passes through the hole 4 to complete the binding operation.

With experience, the binding operation mentioned above becomes simple as follows. On inserting the tip of the hooking portion 1 into the hole 4 in the engaging portion 3,nearly the m iddle of the hooking portion 1 is moved by the ball of the thumb, which has been holding the binding device10, around 80 degrees counterclockwise against the windingportion 2. Such an almost mechanical movement bringsthe tip 5 of the hooking portion 1 close to the hole 4. At thismoment, the thumb, the forefinger and the middle finger ofthe other hand are pressing the object to be bound 6 againstthe U-shaped space 7, in other words, against the winding portion 2. Thus, the binding device 10 is bent. While the thumb keeps guiding the tip 5 of the hooking portion 1 into the hole 4, the thumb and the forefinger of the other handpinch the part of the hooking portion 1 which is emerging from the hole 4 and pull it out to complete the binding operation.

For unbinding, the binding part is held with two fingers of one hand, the thumb and the forefinger. The forefinger is positioned to cover a part of the winding portion and thethumb is inserted between the edge of the engaging portionand the object to be bound. When the upper edge of the engaging portion is held with the thumb and forefinger of thother hand and pulled into the extending direction of the winding portion, the binding is unbound instantly with a click.

As described above, the binding device 10 has a shape to surround three sides of the binding part to make winding to the binding part remarkably easy and speedy. In addition to the mechanical movements of fingertips, it is suitable toguide the tip 5 of the hooking portion 1 into the hole 4 as if going on a fixed track with the root of the hooking portion 1 as the axis. Natural and light movements of fingertips perform the binding operation which can be completed requiring no particular skill.

In the structure described above, repulsion acts. When the winding portion squeezes and winds around the binding part, tension is generated from the binding part against thesurfaces of the winding portion 2 and a part of the engaging portion 3. The tension is dispersed to and received by two sides of the hooking portion 1, reducing itsaction on each part. That is, each of the two sides of the hooking portion 1 shares and bears the tension caused by binding, then, presses itself against the hole edge and the plane of the hooking portion respectively, using the remaining tension. Thus, the fastening becomes perfect.

Moreover, when the dimension W 5 (the dimension between the points i and iii) in the hooking portion 1 is designed larger than the hole diameter W 1 (the diameter through the center of the hole), some difference accrues between the both dimensions. The larger the difference is the more hooking stability is obtained in the hole 4.

When the hole diameter W1 of the hole 4 is constant at any point (e.g., when the hole is a circle), no difference is brought about in hooking stability by positions on the hole edge where the hooking portion 1 is hooked. However,when the hole diameter W1 varies and the difference betweenthe largest and the smallest is large, the hooking position of the hooking portion on the hole edge brings about a largedifference in stability. Therefore, when the hole is shapedother than a circle, that is, when the hole diameter W1 of the hole is not constant but varies, it is necessary to makethe dimension W5 (between the points I and III in the hooking portion 1) correspond to the hole diameter W1.

It is also preferable for hooking stability to make the dimension W4 (between the points I and II in the winding portion 2) smaller than the hole diameter W1 of the hole 4. The reason is that, if the dimension W4 (between the points I and II in the winding portion 2) was made larger, the whole part from near the points I and II to near the points III and IV in the winding portion 2 bends into a curve in the hole 4 because of the difference in dimensions.The bend tends to cause the hooking portion 1's slipping out from the hole 4.

In other words, since the part between the points I and II in the winding portion 2 is designed to stay continuouslyin the hole 4, constant and stable conditions are required. Forhooking stability, as mentioned above, the dimension of this part is desirable to be smaller than the hole diameter of the hole 4.

In order to obtain hooking stability, it is necessary to secure the difference in dimensions between the hole diameter W1 of the hole 4 and the dimension W5 of the border points between the winding portion 2 and the hooking portion 1 (the dimension between the points I and III), and to secure enough length for the border points dimension W5 (between the points I and III). Although this effect is attained by lengthening the width W4 near the tip of the winding portion 2 and the dimension W2 between the points II and III in the hooking portion 1 respectively, it is not desirable, as mentioned above, to make the dimension W4 between the points I and II in the winding portion 2 larger than the hole diameter W1 of the hole 4. Accordingly, enlarging the dimension W2 between the points II and III inthe hooking portion 1 is preferred to secure the dimension W5 between the points I and III.

In this connection, when the dimension W2 between the points II and III in the hooking portion 1 was made moderately larger than the hole diameter W1 of the hole 4, no harm has been observed, as is mentioned in the latter part, and the enlarged W2 fits favorably in every respect. For the dimension W2 (width) between the points II and III in the hooking portion 1, the width W3 near the tip of the hooking portion 1 needs to be somewhat smaller than the holediameter W1 of the hole 4 in order to make the insertion into the hole 4 easy. The other parts of the hooking portion 1 can have much larger dimensions than the hole diameter W1 of the hole 4 without causing any harm.

In binding operation, the hooking portion 1 easily passes through the hole 4 without showing any resistance. The reason why its corner, which is L-shaped against thewinding portion 2, is able to pass through the hole 4 allowing up to the extreme tip of the winding portion 2 to pass, is that the dimension W2 between the points II and III in the hooking portion 1, which is larger than the hole diameter W2, is pushed into the hole 4 getting bent along the hole edge of the hole 4. This bend, forced inevitably, brings about W2 smaller than the hole diameter of the hole 4.

Similarly, the border points between the points I and III, the border of the winding portion 2 and the hooking portion 1, which is situated at the corner in an L-shaped form and has the largest dimension, is also shrunk within the hole diameter by bending in the hole 4. Thus, no resistance is allowed to occur. Even when the hooking limit point III inside the hole has a sharp shape, the sharp part bends in the hole changing its shape to one with no resistance. Thus, no problem nor difficulty arises for the cornered part to pass through Finally, binding operation is completed when the cornered part rebounds and restores its shape after passing through the hole 4. As seen so far, enlarging the dimensionW 2 between the points II and III of the hooking portion 1 does not cause any trouble in operation. When the binding operation is completed, an appropriate length for the dimension W2 between the points II and III of the hooking portion 1 naturally secures an appropriate length for the dimension W5, the border points of the winding portion 2 and the hooking portion 1 (the dimension between the points I and III), making the binding stability perfect.

In respect of the dimension W 5 of the border points of the winding portion 2 and the hooking portion 1, the dimension between the points I and III, when the largest hole diameter of the hole 4 is constant, the larger it becomes the more easily the stability is secured. Utilizingthe difference in dimensions of W2 (between the points II and III) and W5 (the border dimension between the points I and III) is the basis of the present invention. Even when the ratio is 1 for W4 (the dimension between the points I and II of the winding portion 2) and W2 (the dimension between the points II and III in the hooking portion 1) respectively, and 1.41 for the border points dimension W5 between I and III, hooking function is obtained. However, in order to secure more length for the border points dimension W5 between I and III, it is optimum to make only W2 (the dimension between the points II and III in the hooking portion 1) larger, excepting W4 (the dimension between the points I and II in the winding portion 2) which is desired to be smaller than the hole diameter of the hole. The following is the three methods to practice this theory.

(a) When both the winding portion 2 and the hooking portion 1 are linked in nearly a right angle, enlarging W2 (the dimension between the points ii and iii in the hooking portion 1) naturally enlarges W5 (the border points dimension between I and III).

(b) When the angle, at which both the winding portion 2 and the hooking portion 1 are linked, is made more acute than a right angle, the effect enlarges W5 (the border points dimension between I and III) as well as W2 (the dimension between the points II and III in the hooking portion 1).

(c) Further, as occasion demands, (a) and (b) are applied in combination: the angle is made acute, and at the same time W2 (the dimension between the points II and III of the hooking portion 1) is enlarged, followed by enlargement of W5 (the border points dimension between I and III).

Specific examples for each of (a), (b), and (c) above are:

In case of (a), when the ratios are set as 1 for W4 (the dimension between the points I and II in the winding portion 2), and as 1.2, 1.5 and 2.0 for W2 (the dimension between the points I and IV in the hooking portion 1), the ratio of W2 (the dimension between the points II and III in the hooking portion 1) is 1.2, 1.5 and 2.0 respectively, and the ratio of W5 (the border points dimension between I and III) becomes 1.56, 1.80 and 2.23 respectively.

In case of (b), when the ratios are set as 1 for W4 (the dimension between the points I and II in the winding portion 2), and W2 (the dimension between the points I and IV in the hooking portion 1) respectively, and the angle is set at 80°, 70° and 60°, the value of W2 (the dimension between the points II and III in the hooking portion 1) is 1.19, 1.42 and 1.72 respectively, and the value of W5 (the border points dimension between I and III) becomes 1.55, 1.73 and 1.99 respectively.

In case of (c), when the ratios are set as 1 for W4 (the dimension between the points I and II in the winding portion 2), 1.2 for W2 (the dimension between the points I and IV in the hooking portion 1), and the angle formed by the both sides is set at 80°, 70° and 60°, the value of W2 (the hooking limit range in the hole 4, the dimensionbetween the points II and III) is 1.40, 1.64 and 1.95 respectively, and the value of W5 (the border points dimension between i and iii) becomes 1.72, 1.91 and 2.19 respectively.

In this connection, when the angle, at which the winding portion 2 and the hooking portion 1 link, is set at an obtuse angle of 100°, and the ratios are set as 1 for both W4 (the dimension between the points I and II in the winding portion 2) and W2 (the dimension between the points I and IV in the hooking portion 1), the value of W2 (the dimension between the points II and III) becomes about 0.84 and W5 (the border points dimension between I and III) is shown as about 1.3.

Thus, it is evident that the value of the border points dinsion W5 between I and III, which is the essential point of the hooking stability, increases when the angle is less than 90°, and decreases when the angle is greater than 90°.

Accordingly, it is desirable that the range of the angleat the linking part of the winding portion 2 and the hooking portion 1 should vary from being an appropriate acute angle to a right angle.

A more specific description using figures is; it is desirable to set the linking angle of the winding portion 2 and the hooking portion 1 from about 90° to about 60° for the following reasons:

(a) When the angle is set within said range, enough length is easily secured for W5 (the border points dimension between I and III) to stabilize the hooking satisfactorily.

(b) An acute angle up to about 60° does not exert significant effects upon the shape of the adjoining engaging portions 3 within the material framework.

(c) If the linking angle is narrowed beyond 60°, some defects appear;

the shape of the adjoining engaging portion is affected, and the border points dimension W5 between I and III becomes far too long. This causes, in binding operation, too much resistance on passing the part of the border points between I and III through the hole 4. Thus, smooth binding operation becomes impossible.

(d) If the linking angle of both portions is formed beyond said range, and when the upper side of the hooking portion is hooked on the plane of the engaging portion after completion of binding, it becomes hard for both the parts tobe held closely fitted to each other.

The following describes in detail the angle which is formed by the linkage of two portions, the winding portion 2 and the hooking portion 1. There are two types of angle; one starts from the point III being formed by two sides of the hooking portion, and the other starts from the point ibeing formed by one side of the winding portion 2 and the hooking portion 1 respectively.

The angle, which is formed by the both portions, does not need to be the same. The angle, which exerts the largeseffect upon the border points dimension W5 between I and III, is the one which starts from the point III being formedby two sides of the hooking portion 1. Therefore, when thisangle is fixed, the border points dimension W5 between I and III is fixed of itself. By appropriate enlargement of the other angle starting from the point I over the one starting from the point III, the hooking portion 1 can be gradually tapered toward its tip giving the part easy passage through the hole 4.

EMBODIMENT 2

Figure 11:
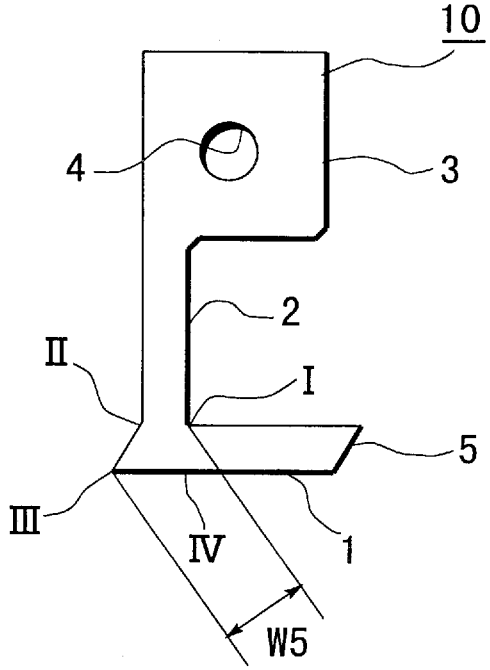
FIG. 11 is a front view to illustrate the completed binding according to a second embodiment of the present invention.

FIG. 11 is a front view of the binding device 10 to illustrate a second embodiment of the present invention, wherein the outer side at the root of the hooking portion 1 is formed as an oblique backward projection, and the hook-inglimit point III, in the hole, is formed by enlarging the border points dimension W5 between I and III. The hooking portion 1, after passing through the hole 4, is securely hooked in this way.

EMBODIMENT 3

Figure 12:
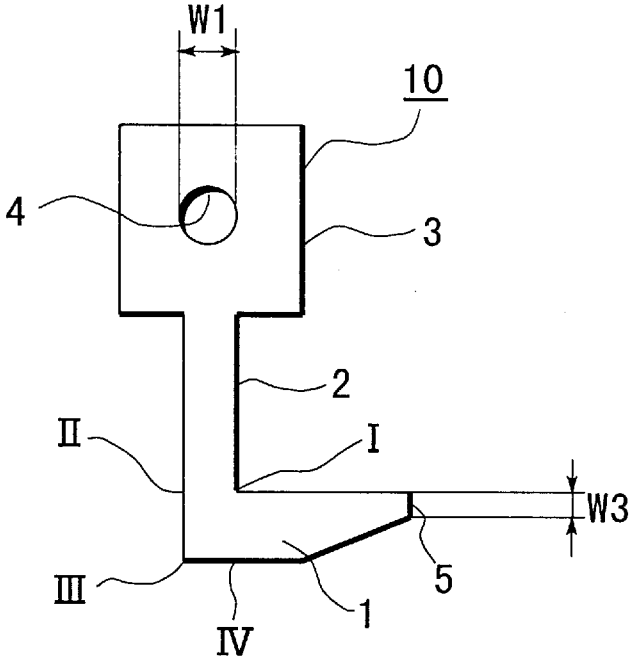
FIG. 12 is a front view to illustrate the completed binding according to a third embodiment of the present invention.

FIGS. 12 through 16 are front views of the binding device 10 to illustrate a third embodiment of the present invention. In FIG. 12, the winding portion 2 is formed at thecenter of one of the outer sides of the engaging portion 3, extending in an appropriate width and length, and from the tip of this winding portion 2, the hooking portion 1, which has an appropriate width and a length of almost the same as the winding portion or with appropriate difference from it, is bent in the direction of a right angle or an acute angle in a nearly L-shaped form against the winding portion. The hooking portion 1 is tapered from midway, and its tip dimension W3 is designed smaller than the hole diameter W1 of the hole 4.

Figure 13:
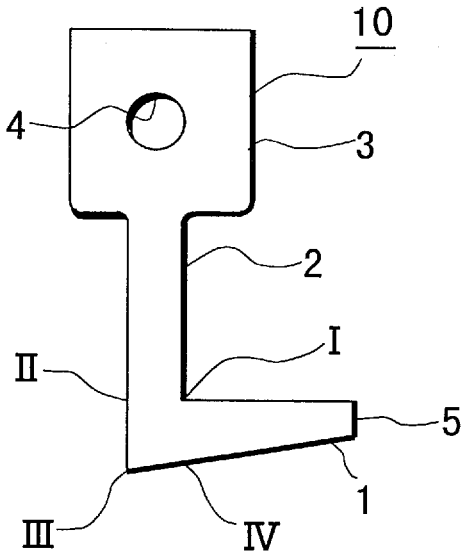
FIG. 13 is a front view to illustrate the completed binding according to a third embodiment of the present invention.
Figure 14:
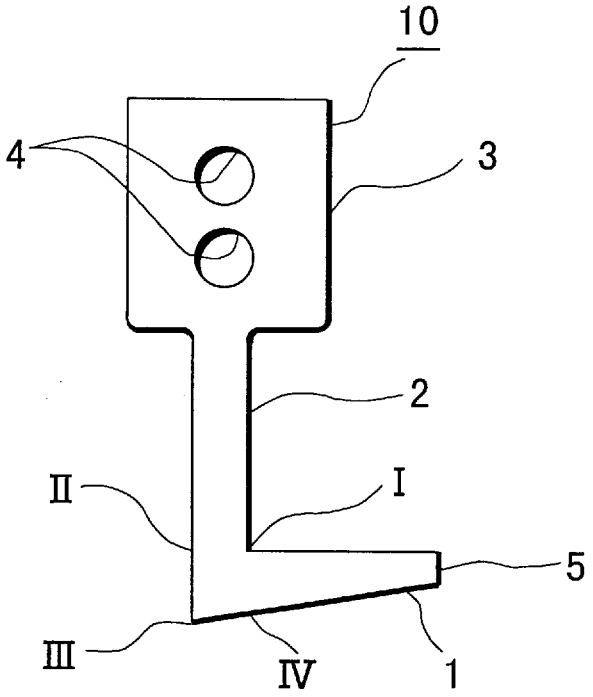
FIG. 14 is a front view to illustrate the completed binding according to a third embodiment of the present invention.
Figure 15:
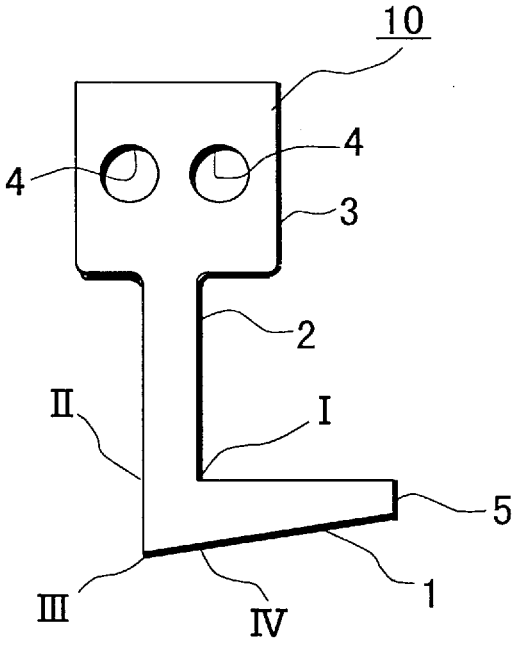
FIG. 15 is a front view to illustrate the completed binding according to a third embodiment of the present invention.
Figure 16:
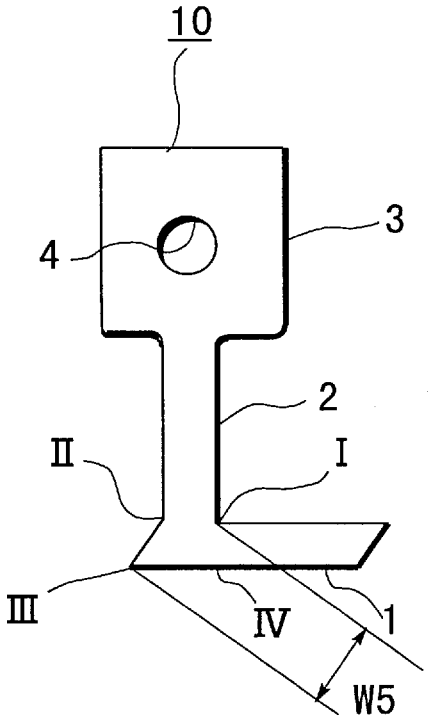
FIG. 16 is a front view to illustrate the completed binding according to a third embodiment of the present invention.
Figure 17:
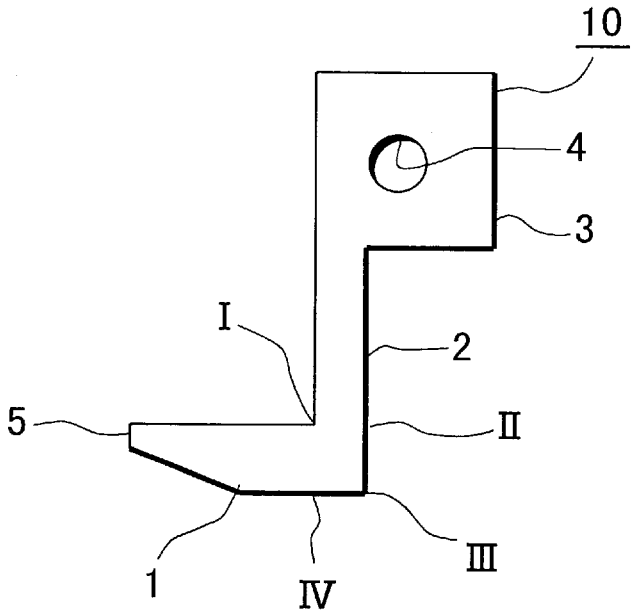
FIG. 17 is a front view to illustrate the completed binding according to a fourth embodiment of the present invention.
Figure 18:
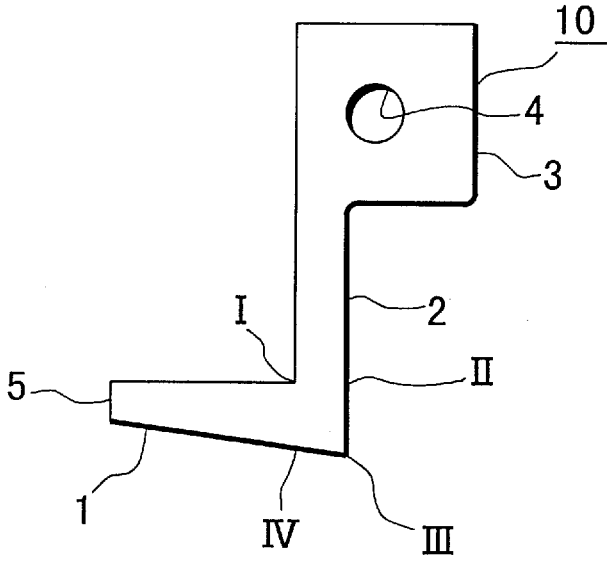
FIG. 18 is a front view to illustrate the completed binding according to a fourth embodiment of the present invention.
Figure 19:
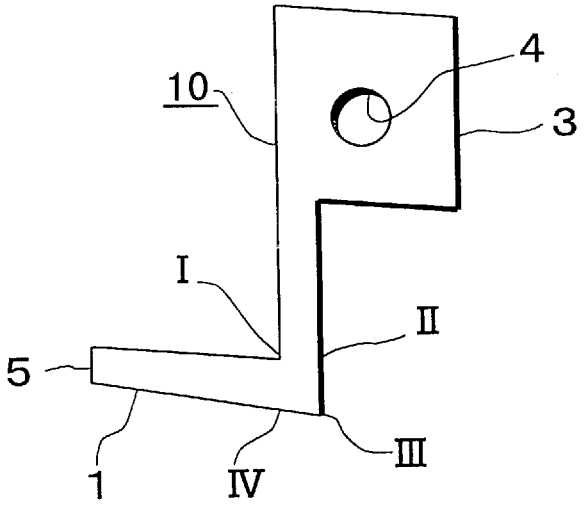
FIG. 19 is a front view to illustrate the completed binding according to a fourth embodiment of the present invention.
Figure 20:
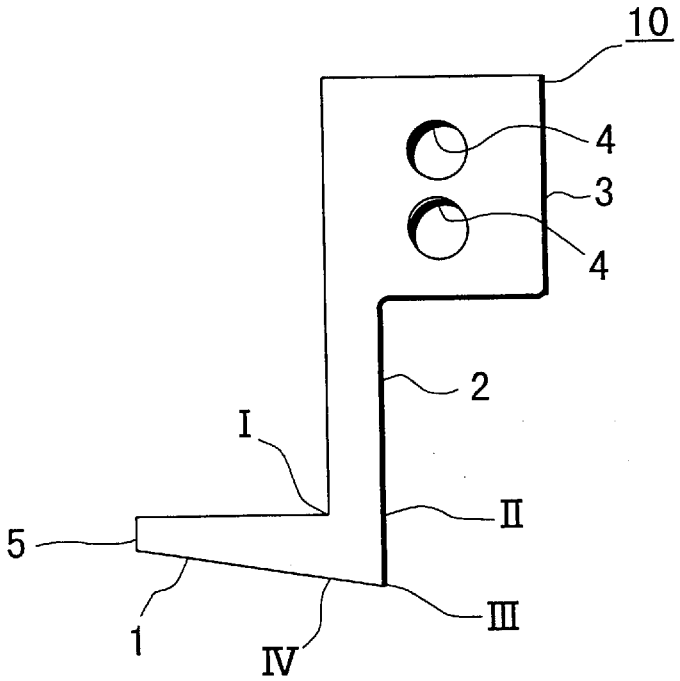
FIG. 20 is a front view to illustrate the completed binding according to a fourth embodiment of the present invention.
Figure 21:
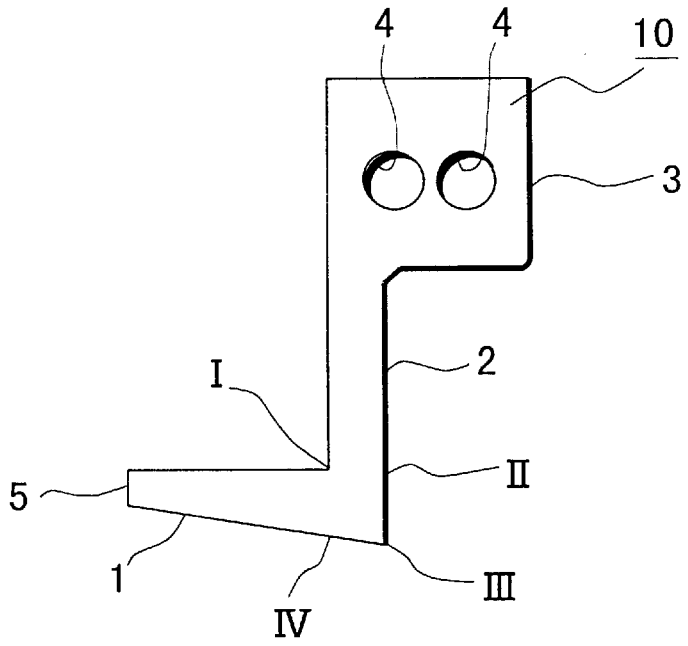
FIG. 21 is a front view to illustrate the completed binding according to a fourth embodiment of the present invention.
Figure 22:
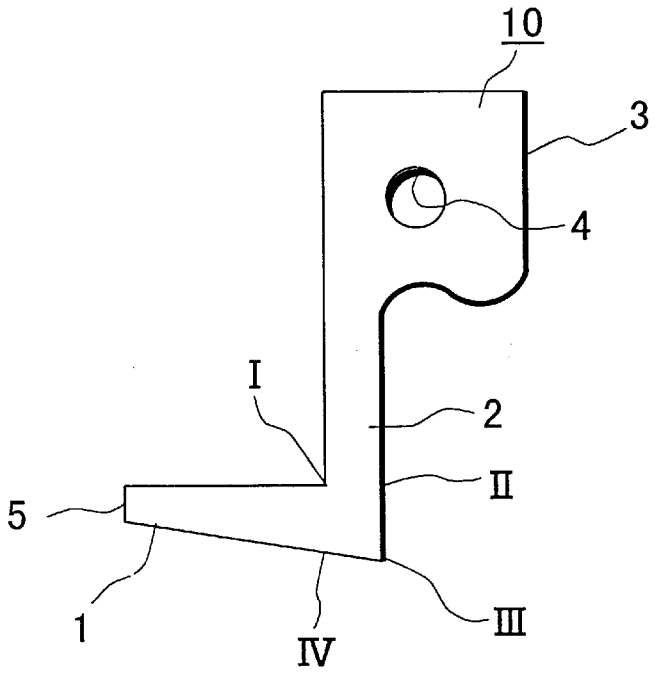
FIG. 22 is a front view to illustrate the completed binding according to a fourth embodiment of the present invention.

The hooking portion 1 may be formed tapering from the root, as shown in FIG. 13. Alternative structures may be; two or more of the hole 4 are formed in parallel with the winding portion 2, as shown in FIG. 14; two or more of the hole 4 are formed in parallel with the hooking portion 1, asshown in FIG. 15; or the outer side of the hooking portion 1at its root may be projected backward to widen the diagonal dimension W5 between the points I and III, as shown in FIG. 16. Thus, unified formation of the portions (the engaging portion 3, the winding portion 2 and the hooking portion 1) leaves the space 7 enclosed on three sides into a U-shaped form.

The binding operation with the binding devices 10, which are manufactured in the ways shown in FIGS. 12 through 16, is the same as the operation with the binding device 10 described in the first embodiment of the present invention-shown in FIGS. 7 through 10. Therefore, the redundant description is omitted.

EMBODIMENT 4

The binding device 10 in a fourth embodiment of the present invention shown in FIGS. 17 through 23, wherein the hooking portion 1 is formed in the opposite direction to theengaging portion 3 with the winding portion 2 positioned between them. Since the rest of the structure is the same as in the cases in FIGS. 1 through 3, and 5 through 7 and 11,the same marks are applied to the same parts, omitting redundant description.

Figure 23:
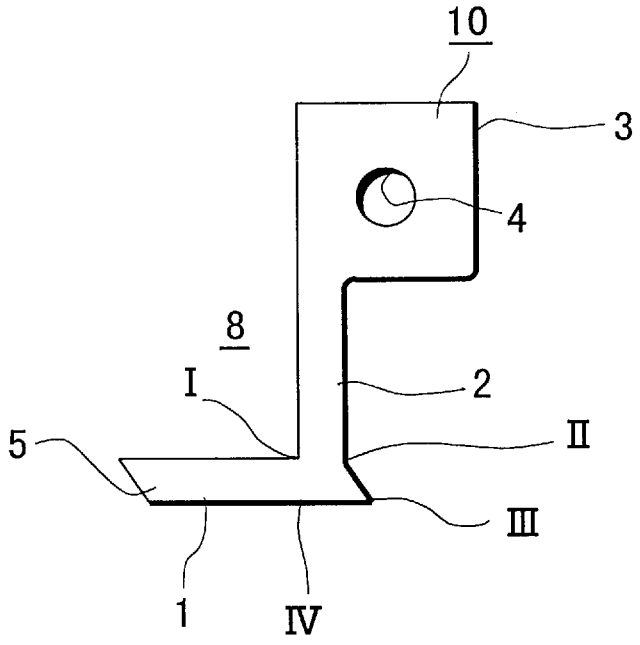
FIG. 23 is a front view to illustrate the completed binding according to a fourth embodiment of the present invention.

Especially, in the structure in FIGS. 11, 16 and 23, only the shape of the hooking portion 1 differs from the other structures. Herein, the hooking portion 1 is slanted starting from the point II of the winding portion 2 or from a point a little below that, outwardly against the extendingdirection of the winding portion 2, and forms the point iii,which works as the hooking limit point in the hole by forming contact with the outer side of the hooking portion 1. The tip dimension W3 of the hooking portion 1 is designed smaller than the hole diameter W1 of the hole 4. In FIGS. 11 and 16, the U-shaped space 7 is formed enclosed by the engaging portion 3, the winding portion 2 and the hooking portion 1. In FIG. 23, a hook-shaped space 8 is formed by the engaging portion 3 and the winding portion 2.

Figure 24:
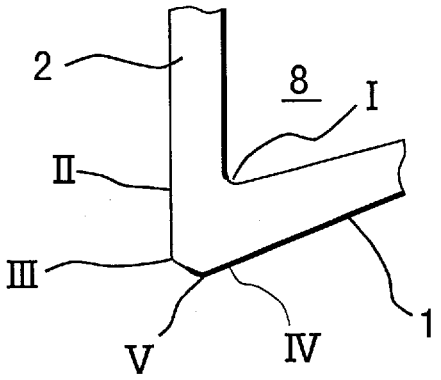
FIG. 24 is a front view to illustrate an applied example-according to a first, second, third and fourth embodimentsof the present invention.

As shown in FIG. 24, when the border points dimension between I and III has enough room, the position III, which works as the hooking limit point inside the hole, and the vertex of the acute angle, is formed a little nearer toward the point II, and at the same time, the point V is formed atthe bordering part of straight lines on the outer side of the hooking portion 1. Both the points, III and V, are connected in a straight line or a curve.

By forming a part of the hooking portion 1 into such a shape, the acuteness of the vertex part III of the acute angle can be reduced into a smooth line. The relation between such shape and angle is expressed by the angle formed by the linkage of the winding portion 2 and the hooking portion 1. That is, one angle is formed by two straight lines starting from the point where the productions of the straight line through the points II and III in the hooking portion 1 and of the straight line through the points IV and V in the hooking portion come in contact with each other.

EMBODIMENT 5

Figure 25:
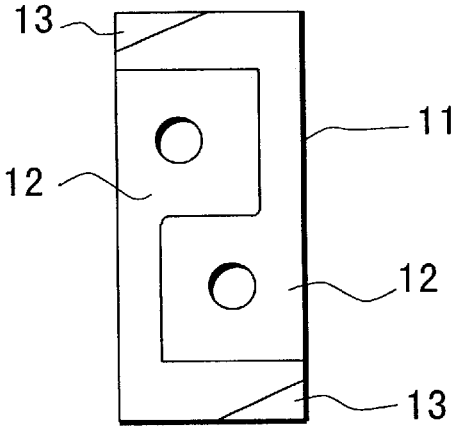
FIG. 25 is a front view to illustrate a manufacturing method according to a fifth embodiment of the present invention.
Figure 26:
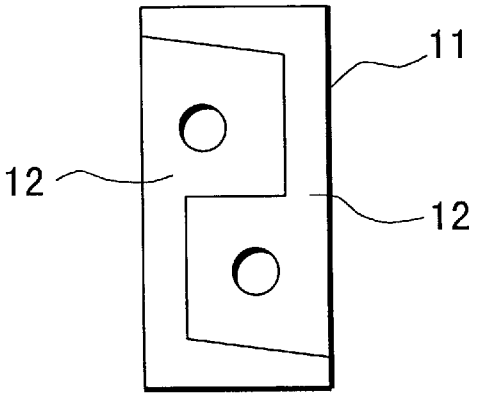
FIG. 26 is a front view to illustrate a manufacturing method according to a fifth embodiment of the present invention.
Figure 27:
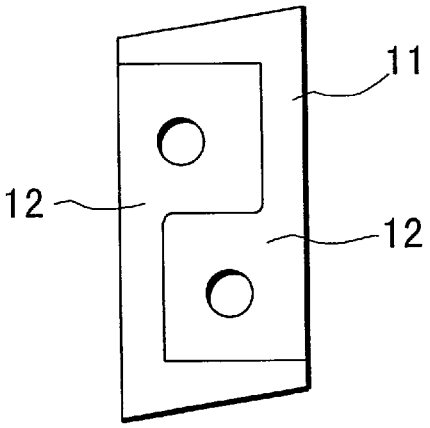
FIG. 27 is a front view to illustrate a manufacturing method according to a fifth embodiment of the present invention.
Figure 28:
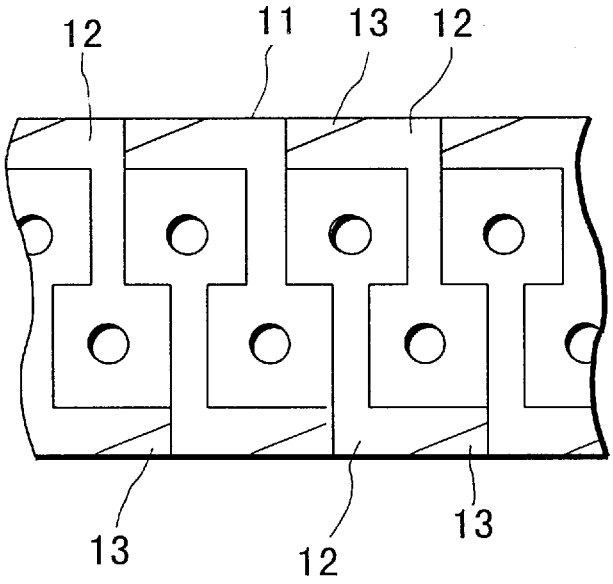
FIG. 28 is a front view to illustrate a manufacturing method according to a sixth embodiment of the present invention.
Figure 29:
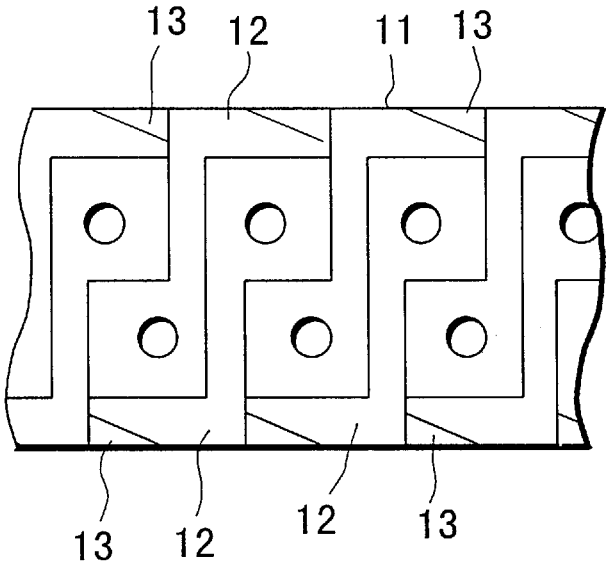
FIG. 29 is a front view to illustrate a manufacturing method according to a sixth embodiment of the present invention.
Figure 30:
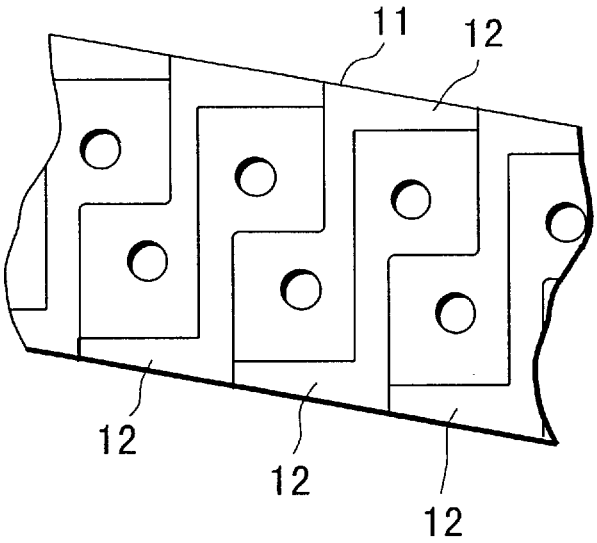
FIG. 30 is a front view to illustrate a manufacturing method according to a sixth embodiment of the present invention.
Figure 31:
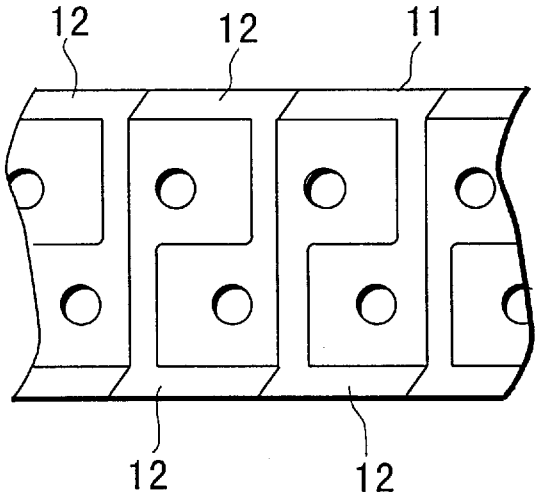
FIG. 31 is a front view to illustrate a manufacturing method according to a sixth embodiment of the present invention.
Figure 32:
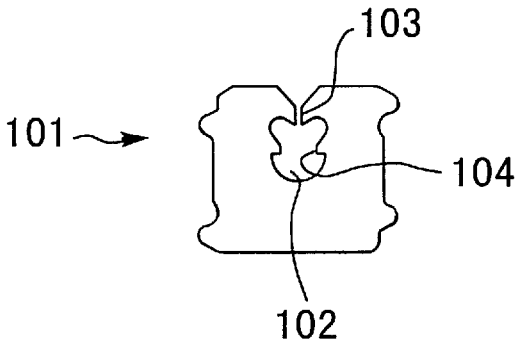
FIG. 32 is a front view to illustrate an example of the related art.

FIGS. 25, 26 and 27 illustrate a fifth embodiment of the present invention which describes the method to manufacture the binding device 10 shown in said FIGS. 1 through 6 above. The material sheet 11, in an appropriate rectangle or parallelogram, is placed as the minimum unit frame, and from which two sets of materials 12 for the binding device are cut in block by positioning them being engaged, adjoining and nearly symmetrical to each other. Then, the unwanted part 13 is cut off from said material for the binding device as occasion demands, forming the engaging portion 3, the winding portion 2 and the hooking portion 1 in a unified manner. In this way, waste of material sheet is avoided and two of the binding devices 10 are efficiently obtained at the same time.

EMBODIMENT 6

FIGS. 28, 29 30 and 31 illustrate a sixth embodiment of the present invention which describes the method to manufacture the binding device 10 shown in FIGS. 11 through 23 above. From the filmy and flexible material sheet 11 in an appropriate rectangle or parallelogram, an appropriate amount of the material 12 for the binding device is cut in block in which the materials 12 are continuously positioned in one line or a plurality of lines being engaged, adjoining and nearly symmetrical to each other. Then, the unwanted part 13 is cut off from the material 12 as occasion demands, forming the engaging portion 3, the winding portion 2 and the hooking portion 1 in a unified manner. The effect of this method is similar to said fifth embodiment, giving a plurality of the binding device 10 at the same time.

As aforesaid, according to one aspect of the present invention, there is provided a binding device, which is manufactured out of a filmy and flexible material sheet forming the three portions in a unified manner; the engaging portion with a hole(s) formed therein, the narrow winding portion which is extending from one side of the engaging portion in order to wind around the binding part of the object to be bound, and the hooking portion which is formed in a nearly L-shaped form at the tip of the winding portion in order to be inserted into and hooked to said hole. The side of the hooking portion is hooked at the edge of the hole with pressure, and the surface of the winding portion, together with a part of the plane of the engaging portion, squeezes the binding part of the object to be bound. Thus, binding becomes firmly secured.

Namely, the stiffness emitted by the side part of the hooking portion makes this part resist easily against the pressed contact to it, bringing about a stable hooking with the pressed contact toward the edge of the hole and the plane of the engaging portion. At the same time, flexibility of the plane of the winding portion, together with the strength against pulling emitted by it, stabilizes the binding.

Additionally, the U-shaped space enclosed by the three portions formed in a unified manner (the engaging portion, the winding portion and the hooking portion) or the hook-shaped spaced enclosed by the hooking portion and the winding portion can instantly envelope the binding part of the object to be bound. And the hooking portion with enough length functions as a guiding portion to guide the winding portion into the hole easily; just holding the hooking portion with finger tips is good enough to guide it into the hole, i.e., a simple mechanical operation by finger tips. Thus, the binding operation is remarkably speeded up.

Further, the hooking portion, which is designed to be held along the longitudinal direction of the object to be held after the binding is completed, makes, together with the winding portion designed comparatively short, the binding part neat and compact without sticking out into the horizontal direction of the packing bag.

The engaging portion with a plurality of the hole formed therein enables a choice of binding sizes, enlarging the coverage of objects to be bound, not only for packing bags for bread or the like but also for a wide range of objects. Besides, the hooking portion or the engaging portion can advantageously carry dates such as "Best if used by . . . " printed on it.

Furthermore, according to another aspect of the present invention, there is provided a method to prepare the binding device, wherein the engaging portion, the winding portion and the hooking portion are designed to be formed in a unified manner by cutting in block of two of the binding device materials arranged in engaged, adjoined and nearly symmetrical position to each other in the minimum unit framework of the filmy and flexible material sheet in an appropriate rectangle or parallelogram, by cutting the unwanted parts off said binding device material as occasion demands. In this way, the remainder from the make-up of one binding device is used, as it were, for making the other adjoining binding device. It is an advantage to be able to prevent loss of material sheet, to improve the efficiency of cutting operation, and to manufacture a much cheaper binding device.

Moreover, since the material sheet is thin enough, such as 0.2 mm or so, cutting of many layers of sheets becomes possible. This improved efficiency in cutting, together with the advantages mentioned above, contributes to reduction of manufacturing expenses. It is naturally understood that the present invention is not limited to the embodiments described above, and various modifications can be made for practice within the scope and spirit of the invention.

What is claimed is:

1. A device for binding the top of a bag, comprising:

a flexible material sheet having an engaging portion with a hole formed therein, a narrow winding portion extending from one side of said engaging portion in order to wrap around the binding part of a bag to be bound; and a hooking portion provided at the tip of said winding portion having a generally L-shaped form in order to be inserted into and hooked to said hole.

2. A device for binding the top of a bag according to claim 1, wherein the width of said hooking portion at the bottom thereof is wider than that of said winding portion at the tip thereof.

3. A device for binding the top of a bag according to claim 1, wherein the corner of said hooking portion at one bottom edge thereof projects backward to form a hooking limit point in said hole.

* * * * *